United States Patent [19]

Van Laeys

[11] 4,089,188

[45] May 16, 1978

[54] EVAPORATOR COIL

[75] Inventor: Edward James Van Laeys, Dover, Pa.

[73] Assignee: Borg-Warner Corporation, Chicago, Ill.

[21] Appl. No.: 770,153

[22] Filed: Feb. 18, 1977

Related U.S. Application Data

[63] Continuation of Ser. No. 591,249, Jun. 27, 1975, abandoned.

[51] Int. Cl.[2] ..... F25D 21/14

[52] U.S. Cl. ..... 62/290; 165/181

[58] Field of Search ..... 62/285, 290, 515, 524, 62/526; 165/111, 181

[56] References Cited

U.S. PATENT DOCUMENTS

| | | | |
|---|---|---|---|
| 2,089,367 | 8/1937 | Harbers | 62/290 |
| 2,667,041 | 1/1954 | Henderson | 62/290 |
| 2,728,204 | 12/1955 | Harbers | 62/290 |
| 3,306,071 | 2/1967 | Holyfield | 62/290 |
| 3,596,475 | 8/1971 | Berger | 62/285 |
| 3,750,418 | 8/1973 | Maudlin | 62/290 |
| 3,923,098 | 12/1965 | Ares | 165/111 |

*Primary Examiner*—Ronald C. Capossela
*Attorney, Agent, or Firm*—Thomas B. Hunter

[57] ABSTRACT

An improved evaporator coil assembly for use in a split system air conditioner. The unit may be installed for heating and cooling operation in one of the following positions: (1) Horizontal; (2) Vertical upflow; or (3) Vertical downflow. It is equipped with improved condensate flow directors which effectively withdraw and discharge condensate collecting on the evaporator fins, regardless of which position it is installed in.

1 Claim, 9 Drawing Figures

EVAPORATOR COIL

This is a continuation of application Ser. No. 591,249 filed June 27, 1975, now abandoned.

BACKGROUND OF THE INVENTION

1. Field of the Invention:

This invention relates to evaporator coils suitable for use in a split residential type air conditioning system in which the evaporator coil is located in a duct or furnace plenum to provide a combined heating and cooling apparatus.

2. Description of the Prior Art:

It is an improvement over the evaporator coil assembly described in U.S. Pat. No. 3,750,418 by Wendell Maudlin, issued Aug. 7, 1973 in that means are provided for directing condensate and causing it to flow to a remote location where it may be discharged to waste. The Maudlin invention has the advantage that the overall height of the evaporator coil assembly may be substantially reduced as compared to the conventional A-frame construction in which condensate merely drains down the two legs of the coil and is collected by a drain system. The Maudlin evaporator, however, is designed only for upflow and downflow installations.

Still another prior art reference showing condensate removal is E. F. Hollyfield, U.S. Pat. No. 3,306,071, issued Feb. 28, 1967.

SUMMARY OF THE INVENTION

This invention is directed to the solution of a problem dictated by field installation requirements for differing air flow patterns through a residential air conditioning-/heating unit. Clearly, it is advantageous to design an evaporator coil assembly which is versatile enough to allow installation on one of several modes; that is, upflow, downflow, or horizontal air flow. The latter is especially important where head room is limited, such as in a basement crawl space or an attic with limited height.

This invention permits the evaporator coil to be installed in any of the three modes described above. In a typical installation, the condensate directors are pointed downwardly in both the upflow and downflow modes. In the horizontal air flow configuration, a separate collecting pan is provided so that the collecting troughs for the upflow and downflow modes are inoperative and do not function as condensate collectors. It is more economical to provide a standard unit which may be adapted to function in any of the three orientations, the decision being made in the field where the choice is dependent on the air conditioner design.

DETAILED DESCRIPTION OF THE INVENTION

Figure 1:
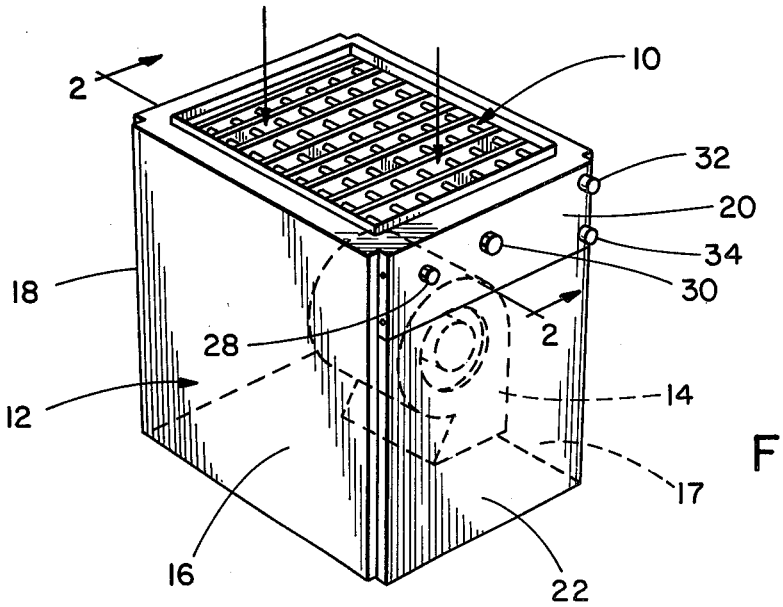
FIG. 1 is an isometric view of an evaporator coil assembly installed in the downflow mode.

Referring now to the drawings, FIG. 1 shows the coil assembly, designated generally by numeral 10, in the downflow mode. The coil 10 is supported within housing 12 above blower 14 so that the air is drawn down through the coil for delivery to a remote location through ducts (not shown). If desired, an electric heating unit (not shown) may be installed at the discharge end of blower 14 to provide all-year comfort conditioning.

Figure 2:
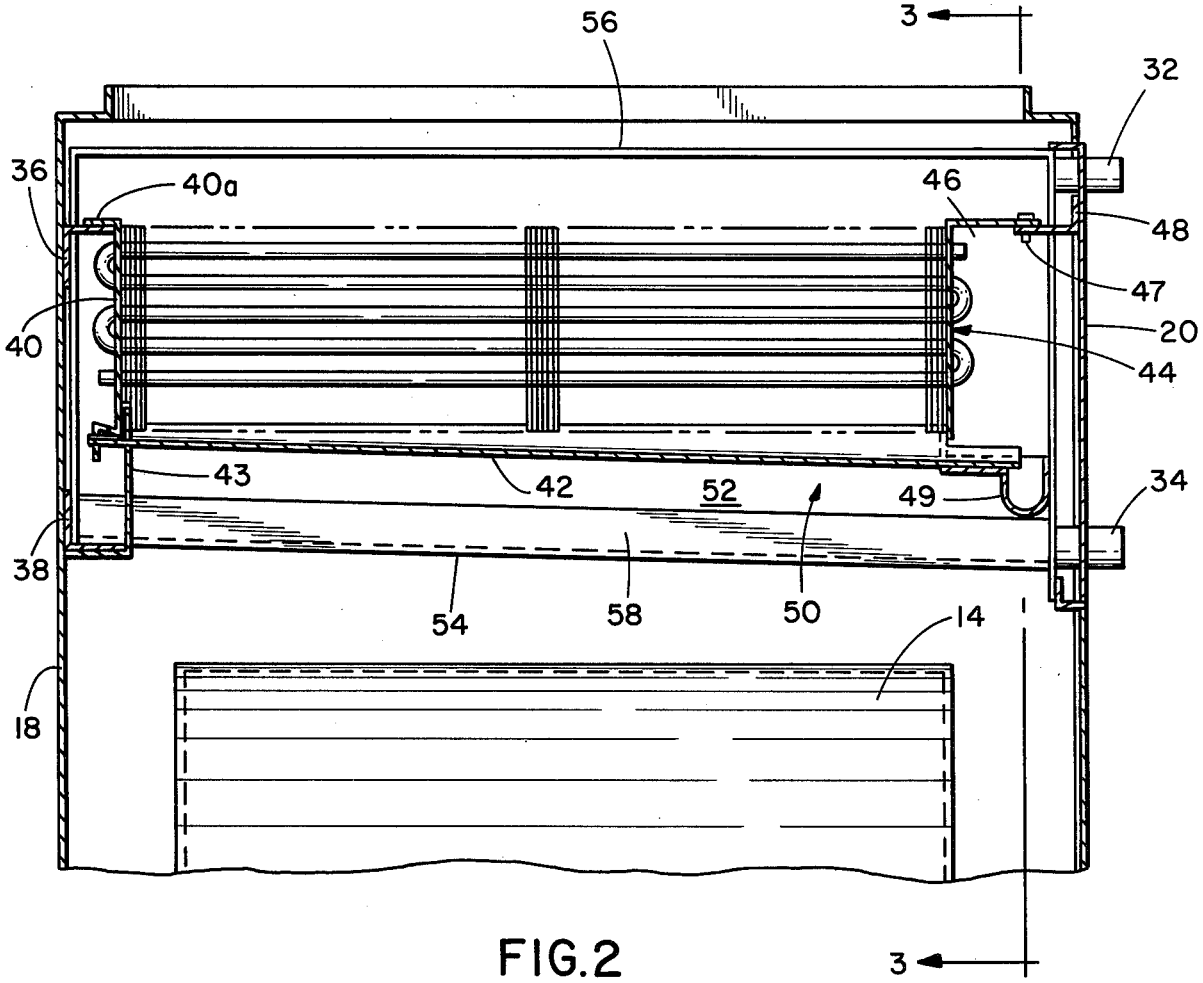
FIG. 2 is a cross-section view taken along the plane of line 2—2 of FIG. 1.
Figure 3:
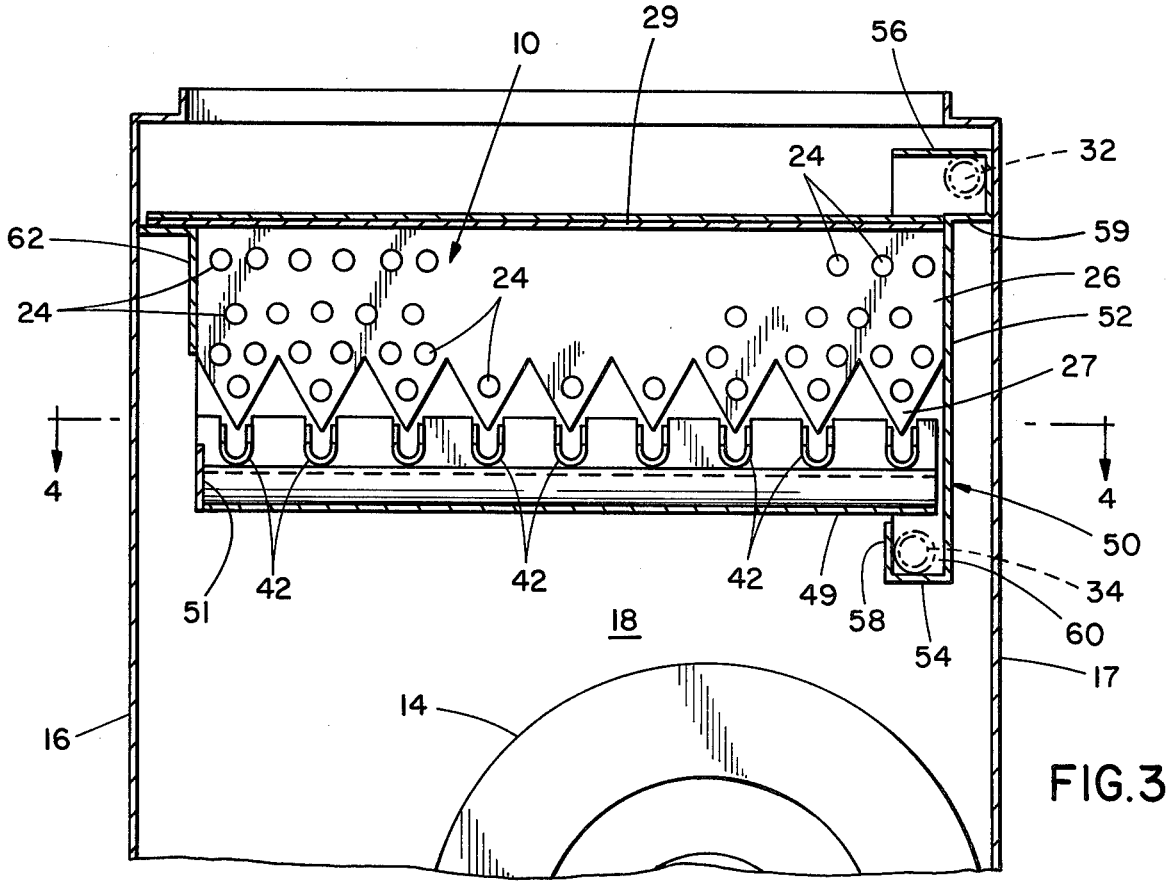
FIG. 3 is a cross-section view taken along the plane of line 3—3 of FIG. 2.
Figure 4:
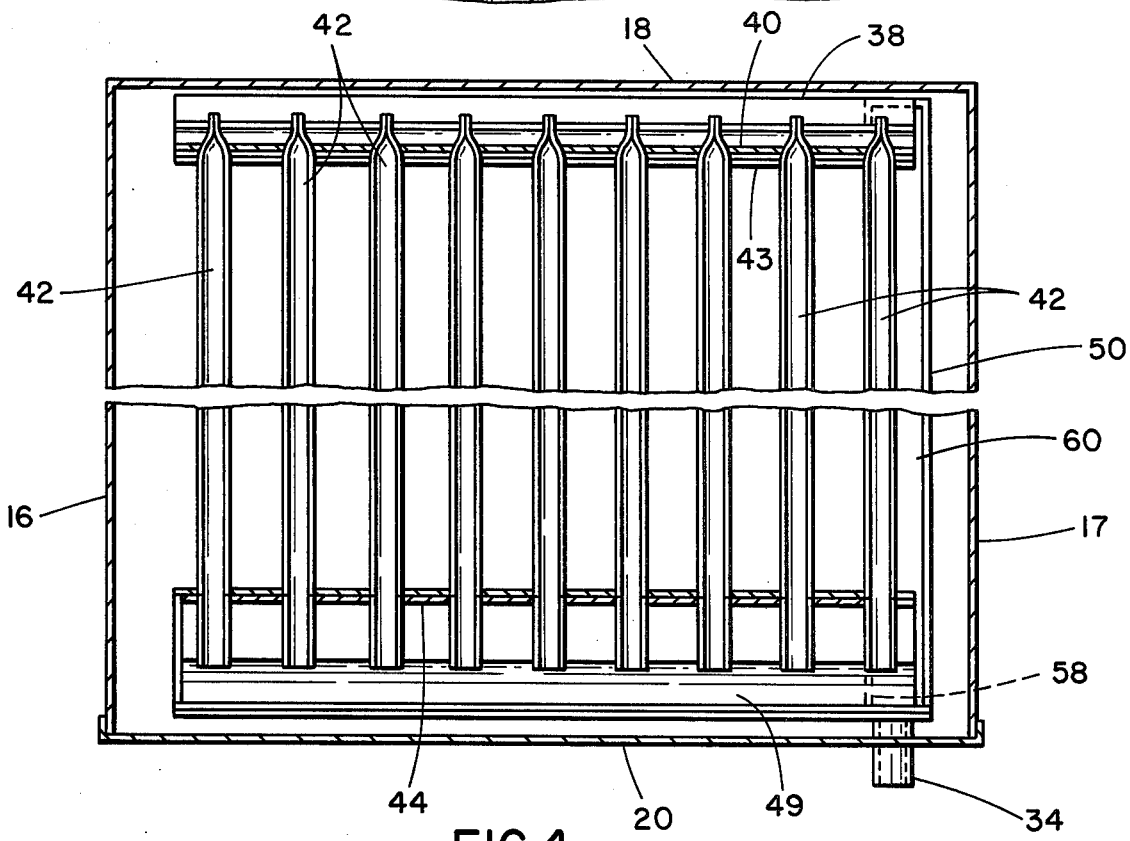
FIG. 4 is a cross-section view taken along the plane of line 4—4 of FIG. 3.
Figure 5:
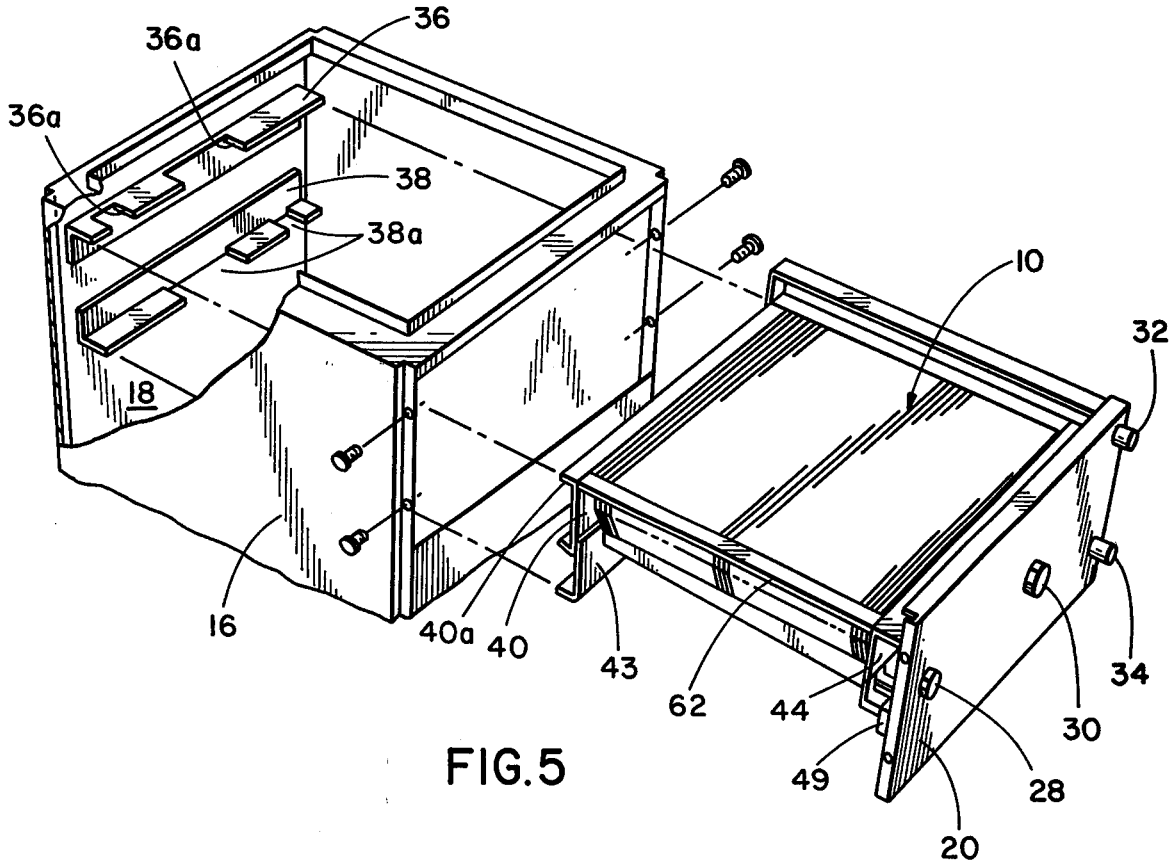
FIG. 5 is an exploded isometric view showing the relationship of the evaporator coil to the housing in which it is installed.

As best shown in FIGS. 2 to 4, the housing 12 includes a pair of side walls 16 and 17, a rear wall 18 and a front panel 20. The front panel 20 of the coil assembly extends across to form a portion of the front wall with panel 22 closing off the remainder.

The evaporator coil 10 comprises a serpentine heat exchange tube 24 having a plurality of spaced heat exchange fins 26 extending transversely across the tube passes. High pressure liquid refrigerant is introduced at connection 28 and the vapor is directed back to the compressor (not shown) through a suction gas line connected at 30. Condensate drain connections, to be described in more detail below, extend out of coil assembly (FIG. 1) at 32 and 34.

As shown at the left hand side of FIG. 2 the rear wall 18 is provided with upper and lower angles 36, 38 which are secured to the wall on the inside thereof and are mounted in parallel relation. In the downflow mode, as shown, the upper angle 36 supports the upper flange of end plate 40 which has several functions including holding the end turns of heat exchange tube 24 and also supporting the upper ends of each of the trough elements 42. A lower bracket 43, also generally L-shaped, extends downwardly and toward the rear wall and is positioned underneath angle 38. At the front of the evaporator coil assembly, a front plate 44, similar to rear plate 40, supports the tube end turns and has a forwardly extending flange section 46 which is secured at 47 to a flange 48 attached to the front panel member 20.

Each of the fins 26 is formed with a lower edge having a plurality of spaced V-shaped elements or teeth 27, similar to those described in the aforementioned Maudlin patent. The purpose of these is to direct the flow of condensate to a point where it flows into the laterally extending trough members 42. A main collecting trough 49 extends transversely across the face of the unit to receive the condensate flowing in each of the individual troughs 42.

As best shown in FIG. 3, a sheet metal pan 50 is disposed on the right-hand side of the unit, the pan being provided with a bottom wall 52, and side walls 54, 56. Side wall 56 has an in-turned lip 58 to form a channel 60 communicating with drain outlet 34. The collector trough 49 is closed at the left-hand end by section 51 but is open at the opposite end to allow run-off of condensate into channel 60 and then to outlet 34.

At the left-hand side of FIG. 3 is a sheet metal component 62 which may be provided in various sizes to accommodate coils of different widths. In a smaller coil version of the FIG. 3 embodiment, there would be fewer troughs 42 and a shorter collecting trough 49.

Figure 6:
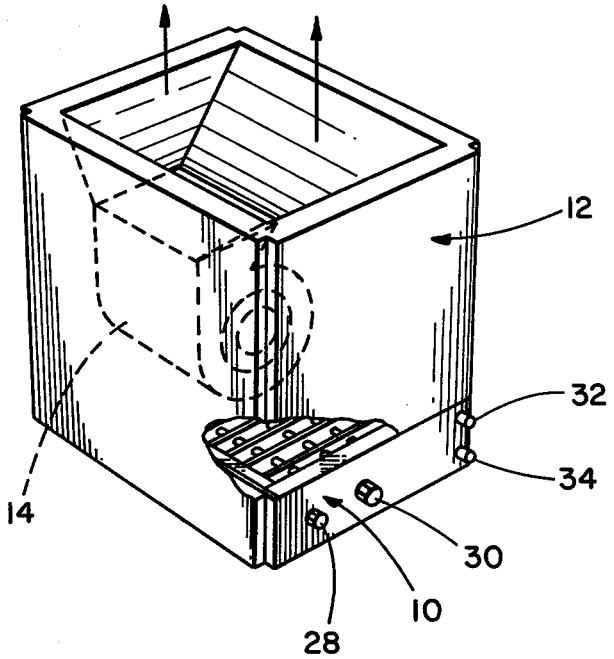
FIG. 6 is an isometric view of the evaporator coil installed in the upflow mode.

FIG. 6 shows the coil assembly mounted in the upflow configuration with blower 14 located above the coil. If an electric heating unit is to be used it would be stationed on the discharge side of the blower. The coil is otherwise in the same relative position with the tooth-like condensate directors 27 depending downwardly and the straight side 29 of the fins facing up. It is also mounted in the housing in the same manner. It should be noted that the two angles 36 and 38 are formed with notches **36*a* and 38*a* in a reversed pattern so that when the coil assembly is installed upside down and the housing rotated 180° around the horizontal, angle 36 will be on the bottom and 38 on the top supporting end plate 40. Another important feature of the invention is the provision of an airflow passage by notch 36*a*. When the coil is assembled, the horizontally extending flange 40*a* of end plate 40 does not completely cover the notched area. In other words, the edge of flange 40*a* does not extend to the back (parallel) edge of notch 36*a* and thus provides an opening for air to pass into the rear area of the coil. This air will enter the blower inlet through spaces at the ends of angle 38**. This air circulation eliminates the need for anti-sweat insulation on the cabinet in this area.

Figure 7:
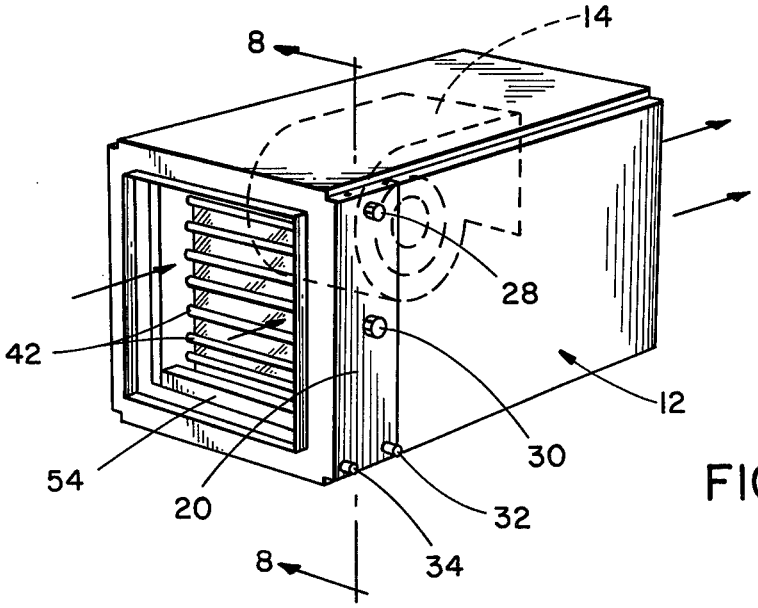
FIG. 7 is an isometric view of the evaporator coil installed in the horizontal flow mode.
Figure 8:
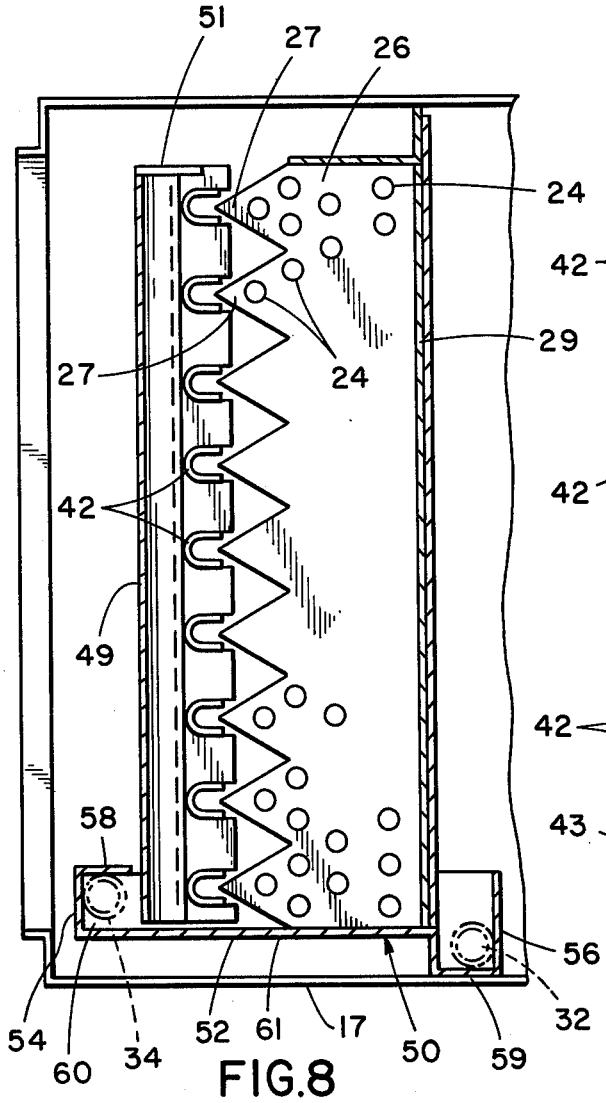
FIG. 8 is a cross-section view taken along the plane of line 8—8 of FIG. 7.
Figure 9:
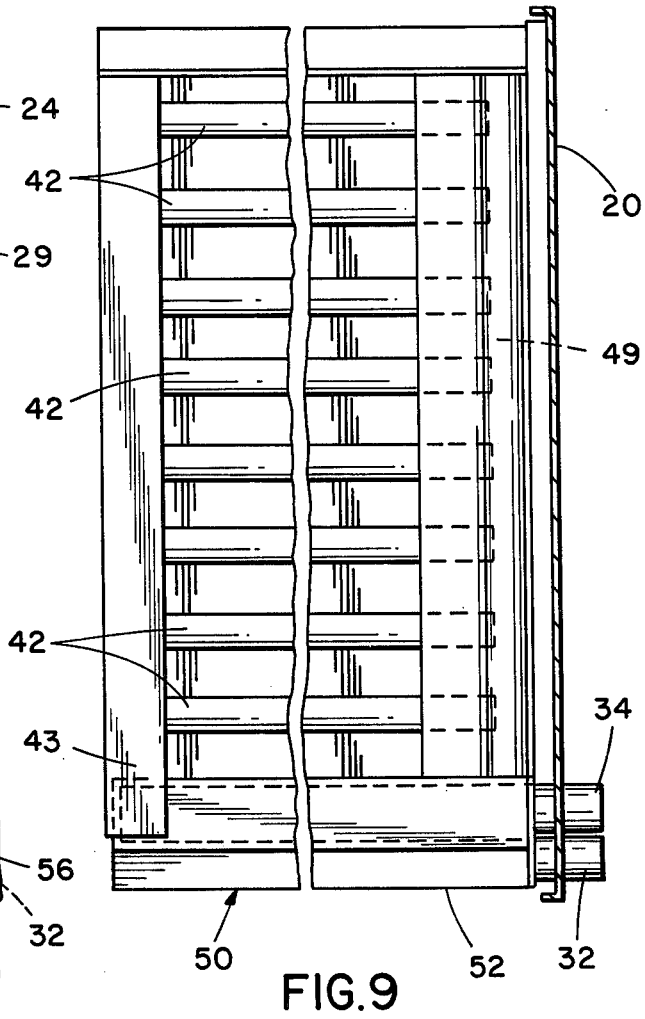
FIG. 9 is a front elevation view of the coil assembly as installed in the horizontal flow mode.

In the horizontal air flow mode shown in FIG. 7 the trough section faces the flow of air and air trails off the straight edges of the fins. In this case pan 50 is oriented so that the bottom wall 52 is horizontal and side walls 54, 56 are vertical. An important feature is the stepped section 59 located adjacent the side edge of the fins. This permits the condensate to flow down below the level of section 61 to move out of the air stream. Otherwise, it has a tendency to be picked up and blown out with the air. Drain connection 32 being lower than 34 now acts as the primary drain; but should it become clogged, drain line 34 will take over and dispose of the condensate.

While this invention has been described in connection with a certain specific embodiment thereof, it is to be understood that this is by way of illustration and not by way of limitation; and the scope of the appended claims should be construed as broadly as the prior art will permit.

What is claimed is:

1. An evaporator coil assembly for use in an air conditioning system of the type in which the evaporator coil assembly is located within a housing through which air to be conditioned is caused to flow through said coil assembly comprising: an evaporator coil including a plurality of tube sections lying in planes which extend perpendicular to the direction of air flow; a plurality of plate-like fins each lying in a plane parallel to the direction of air flow and being in heat exchange contact with substantially all the tube sections traversing said plane, each said fin having at least one edge providing V-shaped tapered portions with the apex thereof arranged at the lowermost condensate discharge point of each fin; a plurality of spaced parallel condensate-collecting troughs extending substantially the length of said coil portions of said evaporator, said troughs underlying said V-shaped tapered portions of said fins, each trough having a width to underlie only the condensate discharge points of the adjacent fins to collect condensate gravitating from the fins while reducing interference with the flow of air through said passage to a minimum, and a pan extending across one side of said coil assembly, said pan being disposed at substantially a right angle to the plane in which said troughs lie to provide an end wall of the assembly when said assembly is oriented with the airflow in a vertical direction and to provide a bottom wall when said assembly is oriented with the airflow in a horizontal direction, said pan having a first upturned side wall, a bottom wall, a second upturned side wall, and a stepped portion adjacent said second side wall lying below said bottom wall and forming a channel, a first drain connection communicating with said channel and a second drain connection through said first side wall above the plane of said bottom wall, whereby said second drain connection provides an overflow path in the event a malfunction occurs in association with said first drain connection.

* * * * *